US006036081A

United States Patent [19]

Gruber

[11] Patent Number: 6,036,081

[45] Date of Patent: Mar. 14, 2000

[54] FABRICATION OF METALLIC ARTICLES USING PRECURSOR SHEETS

[75] Inventor: David Gruber, Sudbury, Mass.

[73] Assignee: Wyman Gordon, North Grafton, Mass.

[21] Appl. No.: 08/998,543

[22] Filed: Dec. 24, 1997

[51] Int. Cl.[7] ..... B23K 20/00; B23K 31/02; B21D 21/00

[52] U.S. Cl. ..... 228/193; 228/141.1; 228/190

[58] Field of Search ..... 228/141.1, 190, 228/193, 194, 127

[56] References Cited

U.S. PATENT DOCUMENTS

| | | | |
|---|---|---|---|
| 3,481,024 | 12/1969 | Bunn | 29/473.5 |
| 3,678,570 | 7/1972 | Paulonis et al. | 29/498 |
| 3,779,884 | 12/1973 | McMurray et al. | 204/181 |
| 3,854,892 | 12/1974 | Burgess et al. | 29/196.1 |
| 3,900,629 | 8/1975 | Spencer | 428/136 |
| 3,950,841 | 4/1976 | Conn | 228/125 |
| 4,820,355 | 4/1989 | Bampton | 148/11.5 A |
| 4,890,784 | 1/1990 | Bampton | 228/194 |
| 4,948,029 | 8/1990 | Haisma et al. | 228/112 |
| 4,958,763 | 9/1990 | Divecha et al. | 228/193 |
| 5,060,845 | 10/1991 | Suenaga et al. | 228/186 |
| 5,289,967 | 3/1994 | Bampton et al. | 228/190 |
| 5,421,507 | 6/1995 | Davis et al. | 228/194 |
| 5,517,540 | 5/1996 | Marlowe et al. | 376/409 |
| 5,686,190 | 11/1997 | Mennucci et al. | 428/472 |
| 5,863,398 | 1/1999 | Kardokus et al. | 204/298.13 |

*Primary Examiner*—Patrick Ryan
*Assistant Examiner*—Kiley Stoner

[57] ABSTRACT

Articles are fabricated by collating and heating precursor metallic sheets of different compositions. The collated stack of sheets is heated with an applied pressure for a time sufficient to interdiffuse them either partially to produce a controllably modulated structure or completely to produce a homogeneous structure. The sheets may be collated in a form, and may be deformed during or after heating. The composition and structure of the final article is controllably varied from location to location by varying the composition, arrangement, or thickness of the collated sheets. In one embodiment, reinforcements such as fibers are positioned between the sheets.

26 Claims, 6 Drawing Sheets

FABRICATION OF METALLIC ARTICLES USING PRECURSOR SHEETS

BACKGROUND OF THE INVENTION

This invention relates to the fabrication of metallic articles from precursor materials, and, more particularly, to the fabrication of such articles from collated sheets of metals of varying compositions.

Historically, most structural articles made of metallic alloys have been prepared by either casting to shape or casting and then deforming to shape, followed by a final metalworking in some cases. These approaches, while successful for many applications and widely used, typically leave the final article with a degree of internal compositional uncontrollability. Such uncontrolled compositional variation is one of the major causes of premature failure or inefficiency in the use of materials to avoid premature failure.

Some metallic articles are desirably fabricated with compositions that are either controllably homogeneous or controllably inhomogeneous on a microscopic or macroscopic level, at a level of control not possible with conventional casting or deformation processing. In response to this need, a wide variety of sophisticated fabrication technologies have been developed. These include, for example, powder processing techniques wherein powders of a metallic composition are placed into a form and heated and/or forged to a near net shape, often accompanied by homogenizing and other heat treatments.

The available techniques are limited in their ability to achieve controlled compositions and microstructures. Powder techniques cannot be readily used, for example, to produce an article whose composition varies in a regular, controllable manner on a local microscopic scale, nor articles whose composition varies in a regular, controllable manner on a macroscopic scale across the dimensions of the article. Such variations are desirable in a number of types of finished articles, where a graded structure would be desirable or where the required properties vary from location to location.

There is a need for an approach which provides greater control over the composition of the article both on a microscopic level and a macroscopic level. The present invention fulfills this need, and further provides related advantages.

SUMMARY OF THE INVENTION

This invention provides a technique for preparing many types of articles so that the composition of the article varies in a regular, controllable manner either microscopically or macroscopically, and articles produced by this technique. The approach permits the overall shape and features of the article to be defined precisely, while at the same time controlling the composition and thence the microstructure. The approach of the invention is compatible with other intermediate and final metalworking operations.

In accordance with the invention, a method for fabricating an article comprises the steps of selecting a useful metallic composition, and selecting a precursor of the useful metallic composition. The precursor comprises at least two metallic sheets including a first metallic sheet having a first composition and a second metallic sheet having a second composition different from the first composition, and where the first composition and the second composition each are different from the useful metallic composition. The sheet may be in a continuous form, or it may have apertures therethrough, for example in the form of a bidirectional screen. The method further includes collating a sequenced stack of layers of the at least two metallic sheets on a form defining the shape of a final, nonplanar article. At least a portion of each of the metallic sheets is nonplanar. The form may be of any operable type, such as one which has a cavity therein or is a mandrel. The stack is thereafter heated, preferably under a modest applied pressure, to interdiffuse the sequenced layers to form an interdiffused structure having the useful metallic composition and the shape of the article. The heating and optional pressing may be continued to achieve a partial or full interdiffusion of the sheets. The stack may be mechanically worked during or after heating.

This technique may be used to make an article having nonmetallic reinforcement therein by placing at least one nonmetallic fiber or other reinforcement between the two metallic sheets during the collation. The reinforcement is selected so that the metallic sheets do not interdiffuse with the reinforcement. The reinforcement remains after interdiffusion as a separate physical entity embedded in the matrix defined by the interdiffused sheets.

In another embodiment, the useful metallic composition comprises a base metal with at least one alloying element therein. To make such a composition, the first metallic sheet comprises the base metal with a deficiency in the at least one alloying element, and the second metallic sheet comprises the base metal with an excess in the at least one alloying element.

The approach described above permits the composition of the article to be controllably established locally, on a microscopic level, by the selection, stacking sequence, and degree of interdiffusion of the sheets. The composition may also be controllably established on a macroscopic level by varying the selection of the sheets from area to area within the article. Thus, the method for fabricating an article comprises the steps of providing a form defining a useful article, and collating a first stack assembly in a first region of the form, where the first stack assembly comprises a first group of sheets of metals of different compositions. A second stack assembly is collated in a second region of the form, where the second stack assembly comprises a second group of sheets of metals of different compositions. The first stack assembly and the second stack assembly are heated to interdiffuse the first group of sheets and to interdiffuse the second group of sheets. This variation is used where the article desirably has a first composition and structure in one region, which is then varied either abruptly or gradually to a second composition and structure in another region. Typically, the compositional variation is achieved gradually, so that there are no sharp compositional interfaces that might result in mechanical or chemical sites for failure initiation. This gradual variation is achieved by an interleaving of the sheets of the first and second groups.

The approach of the invention defines the composition of the final article by the selection and collation of sheets of precursor materials. The sheets are collated onto a form which defines the overall shape of the article and then heated to bond and interdiffuse the sheets. Once collated, the sheets do not shift positions significantly, so that the as-collated compositional arrangements are maintained. Because the sheets are solid, the amount of shrinkage during heating is much less than for articles produced by powder techniques. The approach of the invention is most suitably applied to high-value parts where the effort required in collation is justified by the need for a well-defined, controllable structure. The approach of using multiple sheets may be employed to provide planes into which incipient cracks are deflected, a crack-stopper geometry, thereby increasing the fracture toughness of the article.

By forming the structure from a sequence of stacked sheets, the amount of internal surface is much smaller than that which would be present if the structure were formed from powders. There is less internal oxide and surface contamination, and there is lower internal porosity. The structure may be inspected reliably due to the predictable location of the interfaces and interdiffused zones between the sheets.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIGS. 5A and 5B are schematic views of collated sheets on a mandrel, wherein FIG. 5A illustrates the fabrication of a ring and FIG. 5B illustrates the fabrication of a pipe;

DETAILED DESCRIPTION OF THE INVENTION

Figure 1:
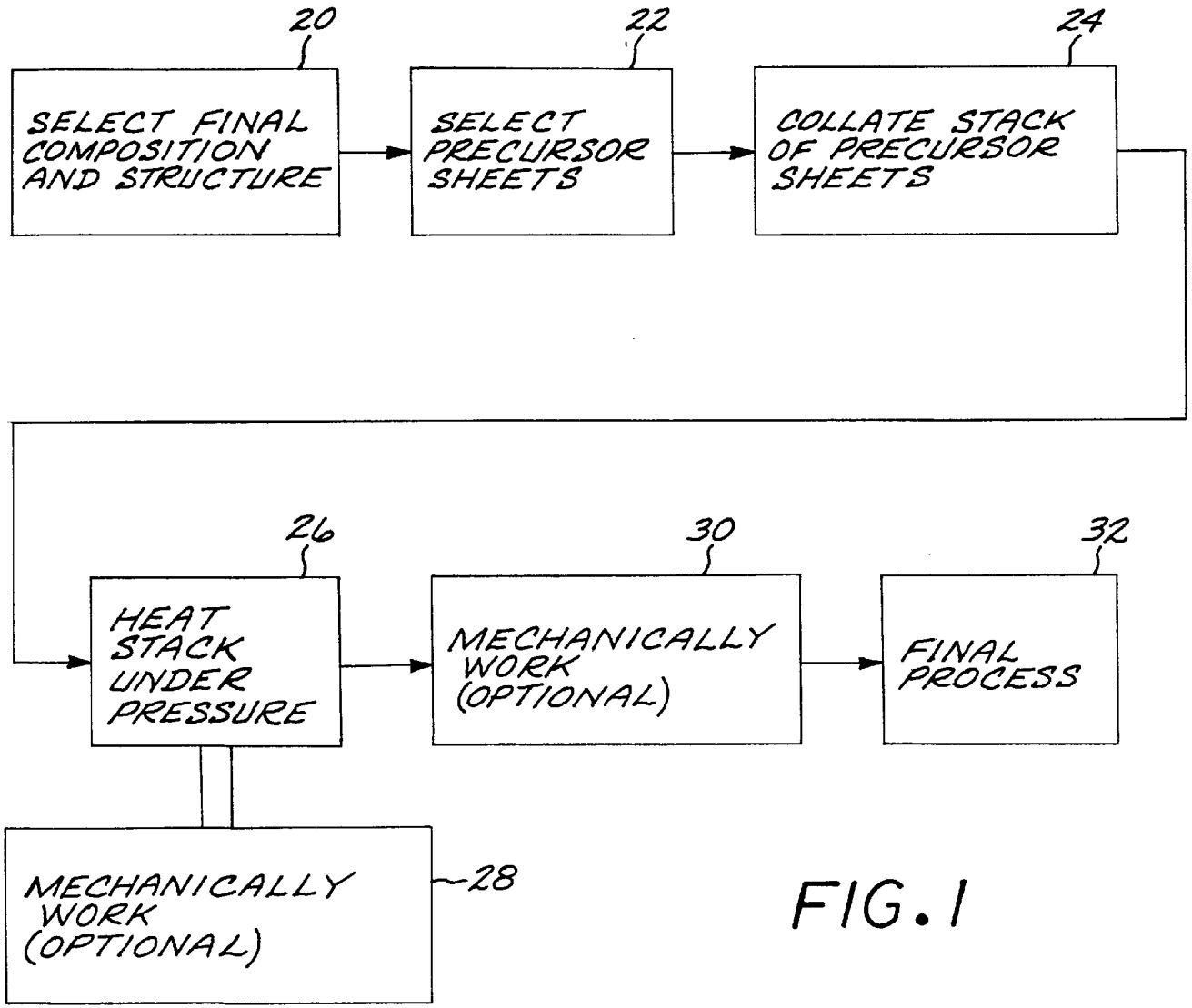
FIG. 1 is a block flow diagram of a first embodiment for practicing the invention.

FIG. 1 depicts one approach to practicing the invention. A useful desired final composition and structure are selected, numeral 20. This composition and structure may include both the microscopic composition to be achieved at all locations throughout the article, as will be discussed here, or may also include macroscopic variations in the microscopic composition to be achieved at different locations in the article, as will be discussed in relation to FIG. 6. Any operable such composition and structure may be selected. The present invention is not generally concerned with particular compositions and structures, but instead provides an approach to fabricating such useful compositions and structures.

Metallic precursor sheets are selected to achieve the desired microscopic composition, numeral 22. The selection of the precursor sheets is according to the final result desired, and cannot be stated generally. An example of a situation of practical interest is illustrative. If the desired final composition and structure are a uniform specific composition, sheets are selected whose volume-weighted net composition is the specific composition desired. In one application, the useful metallic composition comprises a base metal with at least one alloying element therein. The useful metallic composition may not be workable because of low ductility, but compositions with higher and lower amounts of the alloying element may be workable. To produce the useful composition, the first metallic sheet comprises the base metal with a deficiency in the at least one alloying element, and the second metallic sheet comprises the base metal with an excess in the at least one alloying element. The volume-weighted net composition is the desired useful composition. Assuming equal thicknesses of the sheets, the first sheet might be nickel with a 5 percent deficiency in a desired alloying element below that of the desired useful composition, and the second sheet might be nickel with a 5 percent excess in the desired alloying element over that of the desired useful composition. The compositions of the first and second sheets may each be readily deformable, whereas the net final desired composition is not readily deformable. Such situations often arise with intermetallic or ordered desired final compositions in a metallic system. In another example, the sheets may be of completely different and unrelated compositions which are stacked and then interdiffused to make the final desired useful composition.

Figure 2A:
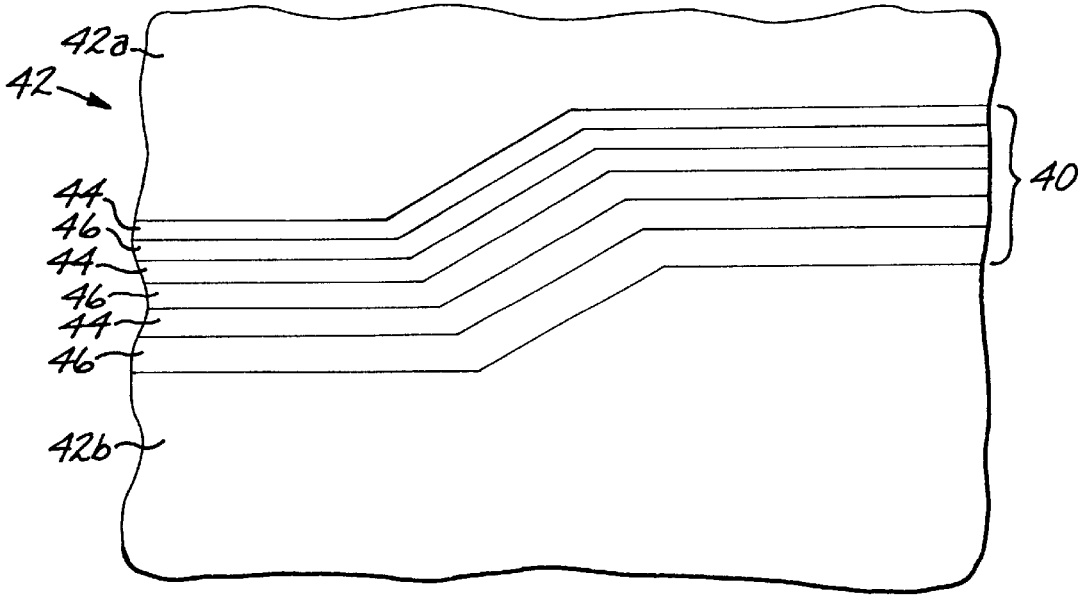
FIG. 2A is an elevational view of collated sheets.

The selected precursor sheets are collated to produce a stack, numeral 24. FIG. 2A illustrates a stack 40 of precursor sheets in a form, which in this case is a forging die 42 having a nonplanar top die 42*a* and a nonplanar bottom die 42*b*. Two different types of precursor sheets 44 and 46 are collated (stacked in order) on the bottom die 42*b*, with the top die 42*a* removed. In the illustration, two types of precursor sheets are arranged in alternating fashion, but more complex sequenced collations of different types and numbers of sheets may be used as desired. An important advantage of the present invention is that it provides a great deal of flexibility in selecting the final composition and structure and the sequences of collated sheets to reach the selected final composition and structure. To accomplish the collating, it may be necessary to deform the sheets by bending to conform to the general shape of the die 42*b*. The bending may be performed manually, with a tool, or by periodically lowering the top die 42*a* into place to deform the sheets already collated into place, removing the top die 42*a*, and then collating further sheets overlying the deformed sheets.

The collated stack 40 is heated, numeral 26, between the dies 42*a* and 42*b*. The stack is heated to a temperature sufficiently high that the sheets 44 and 46 first bond together and then interdiffuse. The interdiffusion may be achieved by any operable mechanism, such as conventional diffusive processes or, under some circumstances, the self-propagating, high-temperature synthesis approach described by D. E. Alman et al., "Intermetallic Sheets Synthesized from Elemental Ti, Al, and Nb Foils", *Metallurgical and Materials Transactions A*, Vol. 26A, pages 2759–2762 (October 1995).

Pressure may be, and preferably is, applied to the stack during the interdiffusional heating 26 by applying a force through the dies 42*a* and 42*b*. The pressure holds the sheets in close facing contact so as to encourage the interdiffusion initially and also deforms the sheets so as to remove voids and other such defects that may be present.

Figure 2B:
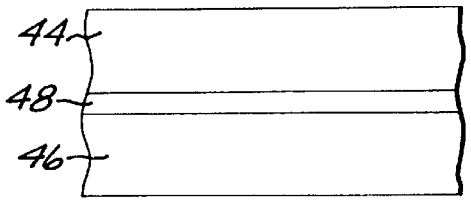
FIG. 2B is an elevational view of partially interdiffused sheets.

The heating may be continued for a period of time sufficient to achieve either a partial or a complete interdiffusion of the sheets 44 and 46. FIG. 2B illustrates a case of partial interdiffusion to produce a controllably modulated structure, wherein at least some of the original material of the sheets 44 and 46 remains, but there is an interdiffusion zone 48 of different composition that is the product of the interdiffusion of the sheets 44 and 46. In the example mentioned above, the sheet 44 might be deficient in the alloying element, the sheet 46 might have an excess of the alloying element, and the interdiffusion zone 48 would have the desired final amount of the alloying element. The structure of FIG. 2B is an interdiffused composite material with the interdiffusion zone 48 sandwiched between the sheets 44 and 46.

Figure 2C:
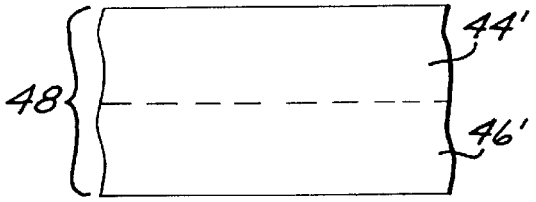
FIG. 2C is an elevational view of fully interdiffused sheets of the same starting composition.

FIG. 2C illustrates a case of complete interdiffusion, so that the entire structure has a uniform, homogeneous composition of the interdiffusion zone 48. Regions 44' and 46' are marked to correspond to the original sheets 44 and 46, respectively, but these regions 44' and 46' do not physically exist in the final interdiffused structure.

Figure 2D:
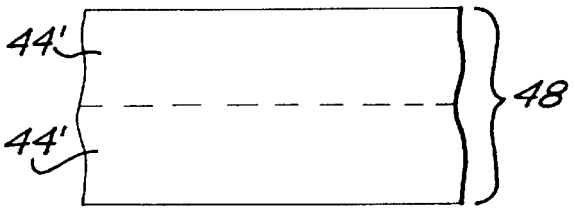
FIG. 2D is an elevational view of fully interdiffused sheets of different starting compositions.

FIG. 2D illustrates a second case of complete interdiffusion, where the initial sheets are all of a single composition, here denoted as the sheet 44'. The final interdiffused zone has that same composition. This collation of sheets of the same composition has important advantages in producing an article which has a uniform composition and microstructure throughout a region. If such an article were produced by a conventional casting operation of a molten metal, for example, there would be uncontrolled variations in composition from region to region as a result of natural solidification effects. This problem may be significant for complex alloys having many alloying elements. Even subsequent mechanical working does not completely remove the inhomogeneity. The present approach results in a controllable composition throughout the article after interdiffusion, avoiding the composition irregularities that may result from casting.

The collated stack may optionally be mechanically worked during the interdiffusional heating step, numeral 28, or after the interdiffusional heating step is complete, numeral 30. The mechanical working during interdiffusion, numeral 28, is the natural result of maintaining a sufficiently high pressure with the top die 42*a*. There may also be additional deformation during the interdiffusional heating step to form the sheets as they are interdiffusing. The mechanical working 30 after the interdiffusing treatment has been completed is ordinarily used to form the interdiffused article to a final shape. Such final mechanical working is used with caution, however, because in many cases the interdiffused zone 48 is not readily deformable—the objective of the procedure in some cases is to produce an article that was not otherwise producible due to the inability to deform a particular composition. In such a case, post-interdiffusion mechanical working 30 would be avoided.

The diffused stack is final processed, numeral 32, using any operable technique, such as final machining or grinding, deburring, removing die flash, surface processing, attaching other elements, etc. The diffused stack is formed to a near net shape by the dies 42*a* and 42*b* by the described prior processing, a desirable result that minimizes the amount of subsequently required final processing such as machining.

Figure 3:
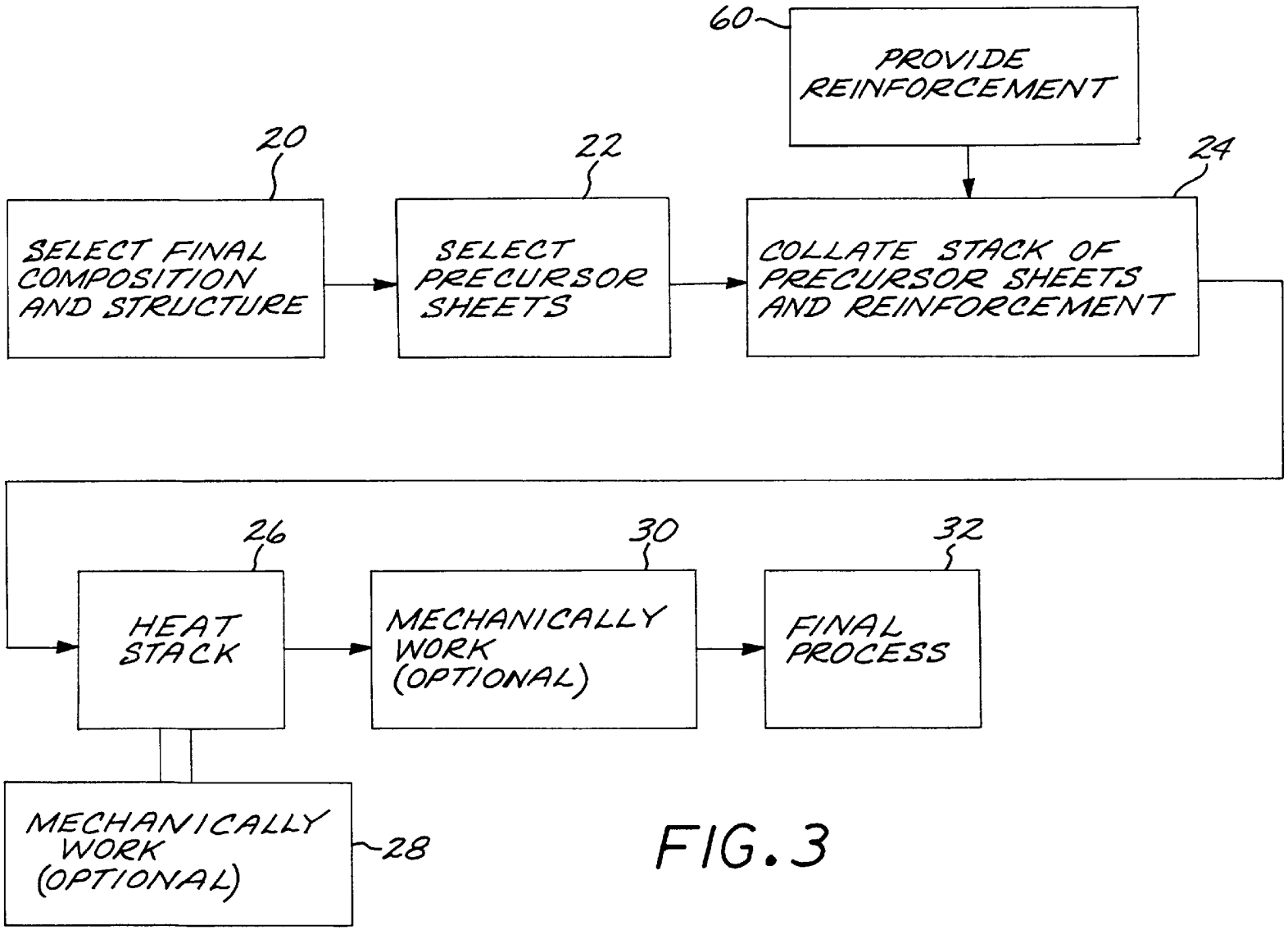
FIG. 3 is a block flow diagram of a second embodiment for practicing the invention.

FIG. 3 illustrates a variation of the above-described approach, wherein a reinforcement is provided for use in the collated stack, numeral 60. The reinforcement may be any operable material, but it is preferably fibers of a material that does not interdiffuse with the sheets 44 and 46, such as a ceramic fiber. There may be a small amount of diffusional reaction such as the formation of an intermetallic at the surface of the reinforcement, but there is preferably no general interdiffusion such that the reinforcement disappears as a separate physical element. The fibers are preferably unidirectional but bound into a mat for easy placement during the collation. The steps 20, 22, 26, 28, 30, and 32 are substantially as described above in relation to FIG. 1. The step 24 is substantially as described in relation to FIG. 1, except that reinforcement is incorporated into the stack as it is collated.

Figure 4:
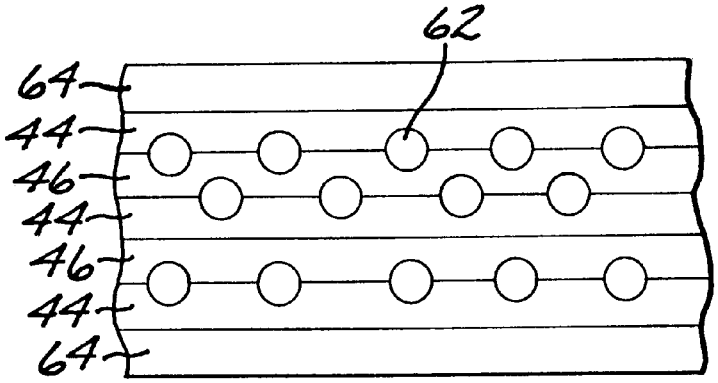
FIG. 4 is an elevational view of collated sheets and reinforcement.

FIG. 4 depicts a composite material made according to the approach of FIG. 3, during the early portions of the step 26 and before substantial interdiffusion has occurred. The fibers 62 are positioned between and bonded to the sheets 44 and 46. As time proceeds, the layers 44 and 46 interdiffuse in the manner discussed above in relation to FIGS. 2A–2D, but the fiber reinforcement 62 remains substantially unchanged. FIG. 4 also illustrates that the fibers may be regularly or irregularly spaced, that there may be fibers between some sheets and not others, and that face sheets 64 may be bonded to the stack. The face sheets 64 may interdiffuse with the neighboring sheets, or they may be selected to have special compositions such as compositions with corrosion-resistant properties which interdiffuse only to a limited extent.

This approach of incorporating fibers into the stack of collated sheets has important applications and advantages. For many articles of commercial interest, the major service loads are applied in predictable directions, and the fibers may be oriented to carry the service loads. For example, a rotating disk has its greatest service loads applied in the radial direction, and the fibers may be incorporated into the stack in the radial direction from a hub toward a periphery, in the manner of the spokes of a wheel.

Figure 5A:
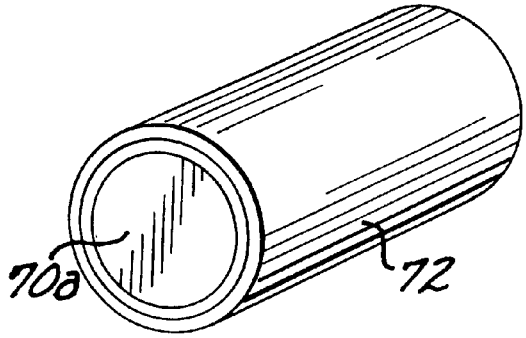
Figure 5B:
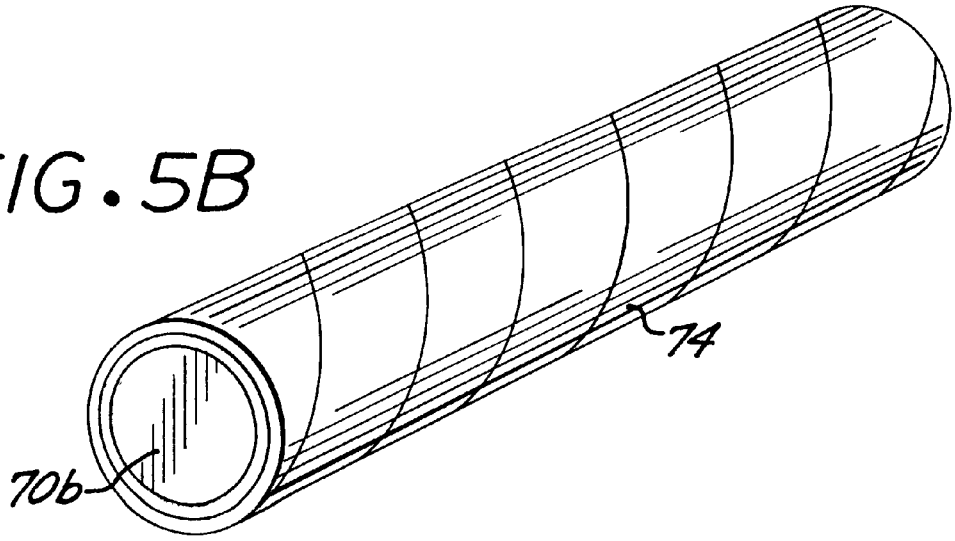

FIG. 2A illustrated a form in the shape of a die having a cavity in which the sheets are collated. FIGS. 5A and 5B illustrate a different form, in the shape of mandrels 70*a* or 70*b* upon which the sheets are collated. In FIG. 5A, a short mandrel 70*a* is used, and the resulting article is a ring 72 with the interdiffused structure discussed earlier. In FIG. 5B, a long mandrel 70*b* is used, and the resulting article is a pipe 74 with the interdiffused structure discussed earlier. The sheets may be collated generally as described above, and as illustrated for FIG. 5A. The sheets may instead be provided in the form of elongated strips, and wound onto the mandrel on a bias relative to the direction of elongation of the mandrel, as illustrated in FIG. 5B. This pipe 74 has a continuous length with no circumferential seams. This approach may be utilized in conjunction with all of the variations discussed previously, permitting the manufacture of a wide range of structures in the ring or pipe.

An important feature of the present approach is the ability to control the microstructure of the article macroscopically as well as microscopically. This means that the collation and interdiffusional approach whose end products described in relation to FIGS. 2A–2D determines the local microstructure of the article. The present approach allows the microstructure at a second, different location of the article to be quite different than that at a first location, by using the approach of FIG. 6 and illustrated in FIG. 7.

Figure 6:
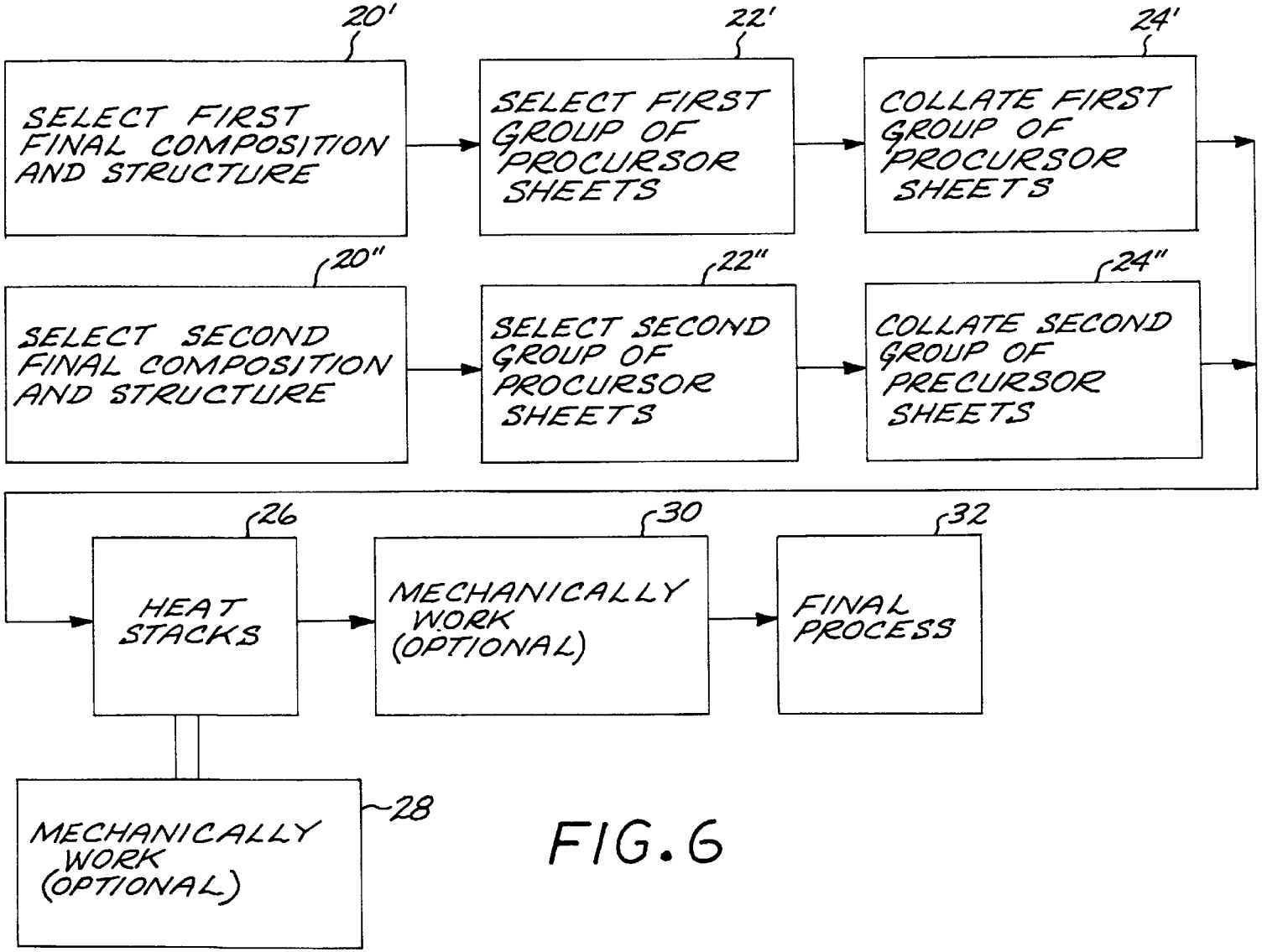
FIG. 6 is a block flow diagram of a third embodiment for practicing the invention.

Referring to FIG. 6, a first final composite structure to be produced in a first region of the article is selected, numeral 20', and a second final composite structure to be produced in a second region of the article is selected, numeral 20". A first group of precursor sheets that will produce the first final composite structure is selected, numeral 22', and a second group of precursor sheets that will produce the second final composite structure is selected, numeral 22". The first group of precursor sheets is collated onto the form (for example, the die 42*b* in FIG. 7) at a first location of the final article, numeral 24', and a second group of precursor sheets is collated onto the form at a second location of the final article, numeral 24". Optionally, reinforcement may be incorporated into either or both of the stacks, as described in relation to FIG. 3. All of these steps are comparable to the respective steps 20, 22, and 24 discussed earlier, and those discussions are incorporated here, except that they utilize different stacks of precursor sheets in different locations.

The stacks are thereafter heated, numeral 26, to interdiffuse them. That is, the first group of precursor sheets is interdiffused within itself, and the second group of precursor sheets is interdiffused within itself. The precursor sheets of the first group and the second group may also undergo interdiffusion at the join lines between the first group and the second group. Mechanical working during heating, numeral 28, or after heating, numeral 30, may be performed. The diffused article may be final processed, numeral 32. These steps are the same as discussed earlier.

Figure 7:
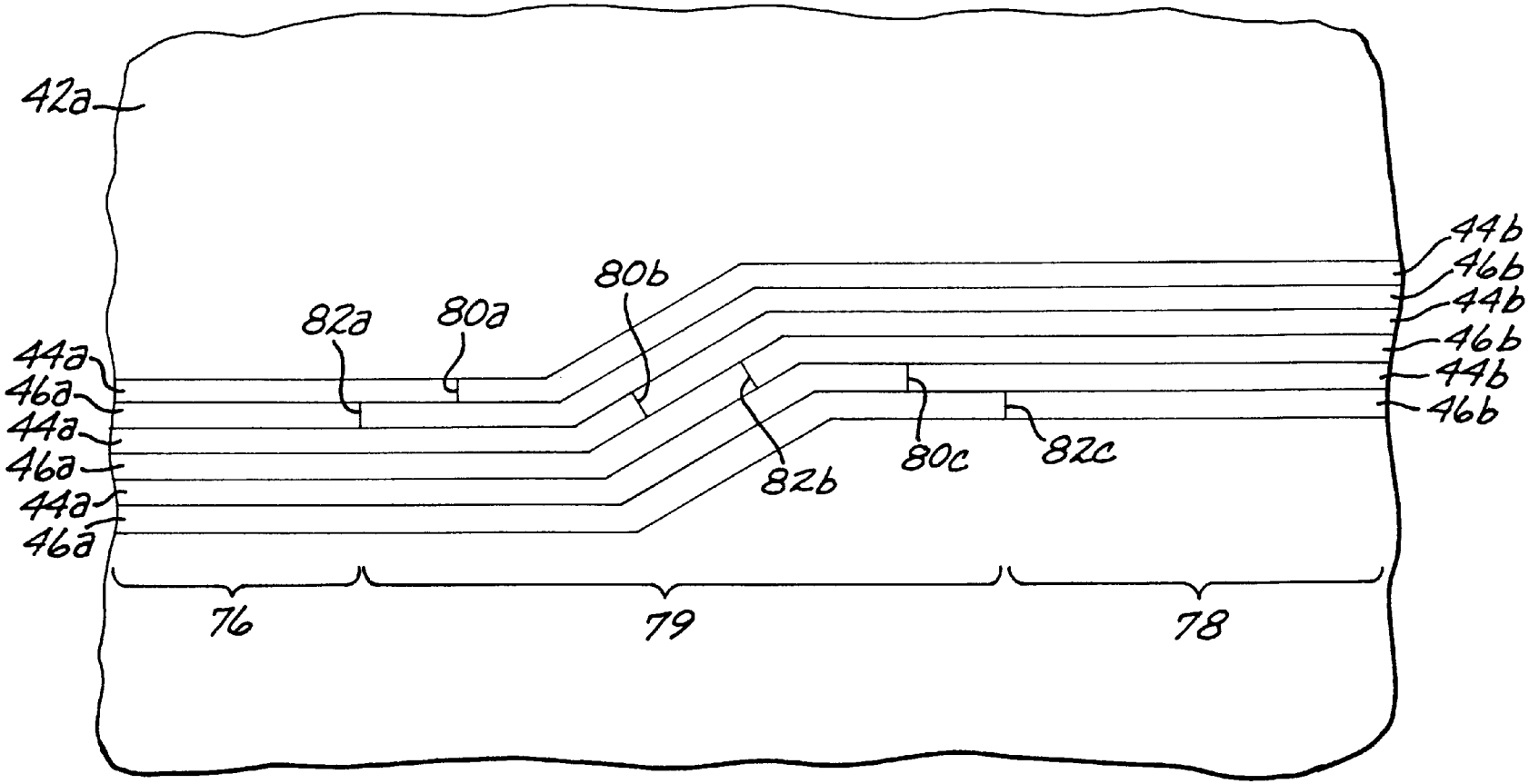
FIG. 7 is an elevational view of collated sheets in accordance with the third embodiment.

FIG. 7 illustrates a stacked arrangement of sequenced sheets, with the sheets being different in two different regions of the article (prior to interdiffusing). In a first region 76, the sheets 44*a* and 46*a* are stacked in a first sequence. In a second region 78, the sheets 44*b* and 46*b* are stacked in a second sequence. The sheets 44*a* and 44*b* may be the same or different materials, and the sheets 46*a* and 46*b* may be the same or different materials. In a transition region 79 between the first region 76 and the second region 78, the join lines 80*a*, 80*b* and 80*c* between the different layers of sheets 44*a* and 44*b*, and the join lines 82*a*, 82*b* and 82*c* between the different layers of sheets 46*a* and 46*b*, are preferably spatially staggered, so that there is not a single continuous join line that may later serve as a failure initiation site. This same staggering approach is used even where all of the sheets of a single layer are the same composition (as in FIG. 1) but the article is so large that multiple sheets are required for each layer.

The ability to controllably vary the structure in different regions of the article provides designers of articles with an important fabrication tool. For example, a disk that is rotated at high speed in service may require optimal high fracture toughness in the first region, and optimal high strength in the second region. The sheets 44*a*, 44*b*, 46*a*, and 46*b* would be selected accordingly. By incorporating selected sheets that produce a small amount of a relatively brittle phase at the plane of interdiffusion, a preferential plane of weakness and a resulting crack-stopper geometry may be produced. Reinforcement may be selectively incorporated as desired. The present invention is not intended to define such approaches for specific articles, only to provide designers with the fabrication capability supporting such design choices.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for fabricating a nonplanar article, comprising the steps of selecting a useful metallic composition;

selecting a precursor of the useful metallic composition, the precursor comprising at least two metallic sheets including a first metallic sheet having a first composition and a second metallic sheet having a second composition different from the first composition, the first composition and the second composition each being different from the useful metallic composition;

providing the first and second metallic sheets;

collating a sequenced stack of the at least two metallic sheets on a form defining the shape of a final, nonplanar article, wherein at least a portion of each of the metallic sheets is nonplanar; and heating the stack to interdiffuse the collated stack of sheets to form an interdiffused structure having the useful metallic composition and the shape of the nonplanar article.

2. The method of claim 1, wherein the step of collating includes the step of placing at least one nonmetallic reinforcement between the two metallic sheets.

3. The method of claim 1, wherein the useful metallic composition comprises a base metal with at least one alloying element therein, wherein the first metallic sheet comprises the base metal with a deficiency in the at least one alloying element, and wherein the second metallic sheet comprises the base metal with an excess in the at least one alloying element.

4. The method of claim 1, including an additional step, performed concurrently with the step of heating, of mechanically working the stack.

5. The method of claim 1, including an additional step, after the step of heating, of mechanically working the interdiffused structure.

6. The method of claim 1, wherein the form includes a cavity in which the at least two metallic sheets are collated.

7. The method of claim 1, wherein the form is a mandrel.

8. The method of claim 1, including an additional step, performed concurrently with the step of heating, of applying a pressure to the stack.

9. A method for fabricating an article, comprising the steps of providing a form defining a useful article;

collating a first stack assembly in a first region of the form, the first stack assembly comprising a first group of sheets of metals of different compositions;

collating a second stack assembly in a second region of the form, the second stack assembly comprising a second group of sheets of metals of different compositions; and heating the first stack assembly and the second stack assembly to interdiffuse the first group of sheets and to interdiffuse the second group of sheets.

10. The method of claim 9, wherein the step of collating includes the step of placing at least one nonmetallic reinforcement between the first group of sheets.

11. The method of claim 9, wherein the step of heating is continued for a sufficient time to achieve a partial interdiffusion of the first group of sheets.

12. The method of claim 9, wherein the step of heating is continued for a sufficient time to achieve a complete interdiffusion of the first group of sheets.

13. The method of claim 9, including an additional step, performed concurrently with the step of heating, of mechanically working the collated structure.

14. The method of claim 9, including an additional step, after the step of heating, of mechanically working the interdiffused structure.

15. The method of claim 9, including an additional step, performed concurrently with the step of heating, of applying a pressure to the stack.

16. A method for fabricating an article, comprising the steps of providing a mandrel;

collating a first sheet of a first metal onto the mandrel;

collating a second sheet of a second metal onto the mandrel overlying the first sheet; and heating the first sheet and the second sheet to bond the first sheet and the second sheet together.

17. The method of claim 16, wherein the step of heating is continued to interdiffuse the first sheet and the second sheet.

18. The method of claim 16, including an additional step, performed concurrently with the step of heating, of mechanically working the collated structure.

19. The method of claim 16, including an additional step, after the step of heating, of mechanically working the bonded structure.

20. The method of claim 16, including an additional step, performed concurrently with the step of heating, of applying a pressure to the stack.

21. A method of fabricating an article, comprising the steps of collating a stack assembly on a nonplanar form, the stack assembly comprising a first sheet of a first metal, a second sheet of a second metal, the second metal being different in composition than the first metal, and at least one nonmetallic reinforcement lying between the first sheet and the second sheet;

heating the stack assembly to cause the first sheet and the second sheet to interdiffuse, but wherein the first sheet and the second sheet do not substantially interdiffuse with the nonmetallic reinforcement, the interdiffused stack having the shape of the nonplanar form.

22. The method of claim 21, wherein the reinforcement is a fiber.

23. The method of claim 21, including an additional step, performed concurrently with the step of heating, of applying a pressure to the stack assembly.

24. The method of claim 21, wherein the form includes a cavity in which the stack assembly is collated.

25. The method of claim 21, wherein the form is a mandrel onto which the stack assembly is collated.

26. The method of claim 1, wherein the stack includes three of the first metallic sheets and three of the second metallic sheets.

* * * * *